US012082688B2

(12) United States Patent
Redondo et al.

(10) Patent No.: US 12,082,688 B2
(45) Date of Patent: Sep. 10, 2024

(54) MAKEUP REMOVAL PAD CLEANER AND STORAGE TOOL HAVING A STONE DESIGN

(71) Applicant: L'OREAL, Paris (FR)

(72) Inventors: Gloriana Redondo, Jersey City, NJ (US); William Robert Bickford, Scotch Plains, NJ (US); Andrea Saverino, Colts Neck, NJ (US); Jason Fyfe, Holmdel, NJ (US)

(73) Assignee: L'Oreal, Paris (FR)

( * ) Notice: Subject to any disclaimer, the term of this patent is extended or adjusted under 35 U.S.C. 154(b) by 667 days.

(21) Appl. No.: 17/332,755

(22) Filed: May 27, 2021

(65) Prior Publication Data

US 2022/0378184 A1 Dec. 1, 2022

(51) Int. Cl.

| | |
|---|---|
| ***A46B 9/00*** | (2006.01) |
| ***A46B 9/02*** | (2006.01) |
| ***A46B 15/00*** | (2006.01) |
| ***A46B 17/06*** | (2006.01) |
| ***A47K 10/42*** | (2006.01) |

(52) U.S. Cl.

CPC ..... *A46B 9/005* (2013.01); *A46B 9/026* (2013.01); *A46B 15/0061* (2013.01); *A46B 17/06* (2013.01); *A47K 10/421* (2013.01); *A46B 2200/3073* (2013.01)

(58) Field of Classification Search

CPC . B65D 83/0805; A46B 15/0061; A46B 9/005; A46B 9/026; A47K 10/421

See application file for complete search history.

(56) References Cited

U.S. PATENT DOCUMENTS

| | | | | |
|---|---|---|---|---|
| 9,826,824 | B2 | 11/2017 | Lim et al. | |
| 9,867,457 | B2 | 1/2018 | Albers | |
| 10,271,637 | B2 * | 4/2019 | Cannon | B08B 3/04 |
| 10,285,494 | B1 * | 5/2019 | Lho | A46B 11/0041 |
| 10,349,734 | B2 | 7/2019 | Xavier et al. | |
| D893,199 | S * | 8/2020 | Sedic | D4/137 |

(Continued)

FOREIGN PATENT DOCUMENTS

| | | | |
|---|---|---|---|
| KR | 20180001172 | U | 4/2018 |
| WO | 2016/080567 | A1 | 5/2016 |

OTHER PUBLICATIONS

French Preliminary Search Report and Written Opinion mailed Apr. 22, 2022, issued in corresponding Application No. FR2108368, filed Jul. 30, 2021, 8 pages.

*Primary Examiner* — Shay Karls

(74) *Attorney, Agent, or Firm* — Christensen O'Connor Johnson Kindness PLLC

(57) ABSTRACT

A pad cleaner is in the shape of a "stone" or an ellipsoid. The pad cleaner has a first surface bowed in the center which curves down from the center radially outward to the edges of the first surface. The pad cleaner has a second surface bowed in the center, which curves up from the center radially outward to the edges of the second surface. The first surface is joined to the second surface at the edges of both surfaces forming a hollow center. There are ridges or spikes extending normal to the second surface that are arranged in a pattern to produce a cleaning effect. The first surface has a cutout extending through a material thickness of the first surface to expose the hollow center. The hollow center can be used to store pads.

14 Claims, 4 Drawing Sheets

(56) References Cited

U.S. PATENT DOCUMENTS

| | | | | |
|---|---|---|---|---|
| D918,586 | S * | 5/2021 | Liu | D4/120 |
| 2014/0045135 | A1 | 2/2014 | Beckman | |
| 2020/0077782 | A1 | 3/2020 | Chen et al. | |

* cited by examiner

MAKEUP REMOVAL PAD CLEANER AND STORAGE TOOL HAVING A STONE DESIGN

SUMMARY

In one embodiment, a pad cleaner comprises a first surface bowed in the center which curves down from the center radially outward to the edges of the first surface; a second surface bowed in the center, which curves up from the center radially outward to the edges of the second surface, wherein the first surface is joined to the second surface at the edges of both surfaces forming a hollow center; ridges or spikes extending normal to the second surface are arranged in a pattern on the second surface; and the first surface has a cutout extending through a material thickness of the first surface to expose the hollow center.

In one embodiment, the pad cleaner comprises pads in the hollow center, and the cutout is for dispensing the pads.

In one embodiment, the pad cleaner comprises discrete ridges arranged in a two-arm spiral on the second surface.

In one embodiment, the two spiral arms originate opposite to each other from the center of the second surface.

In one embodiment, the radial separation distance between the two spiral arms remains constant.

In one embodiment, discrete ridges extend between 45 degrees to 90 degrees of the spiral arms.

In one embodiment, the discrete ridges increase in length with increase in radial distance from the center.

In one embodiment, gaps separate the ends of the discrete ridges.

In one embodiment, the gaps increase in length between the discrete ridges with increasing radial distance from the center.

In one embodiment, the pad cleaner comprises discrete spikes arranged in more than two spiral arms originating from the center.

In one embodiment, the spikes are arranged in twelve spiral arms originating from a circle arrangement of spikes at the center of the second surface.

In one embodiment, the pad cleaner comprises a circular arrangement of spikes at close to the edge of the second surface.

In one embodiment, the first surface and the second surface give an overall ellipsoid shape to the pad cleaner.

In one embodiment, the first surface has three lobes placed equidistant apart from one another around the cutout.

In one embodiment, the first surface and the second surface are made from an elastomer.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

In this disclosure, spatially relative terms, such as "top," "bottom," "side," "lower," "upper," and the like, may be used herein for ease of description to describe one feature's relationship to another feature or features as illustrated in the figures. It will be understood that the spatially relative terms are intended to encompass different orientations of the tool in use or operation in addition to the orientation depicted in the figures. For example, if the tool in the figures is turned over, features described as "bottom" or "lower" in relation to other features or as depicted in the figures would then be considered "top" or "upper" in relation to the other features.

Figure 2:
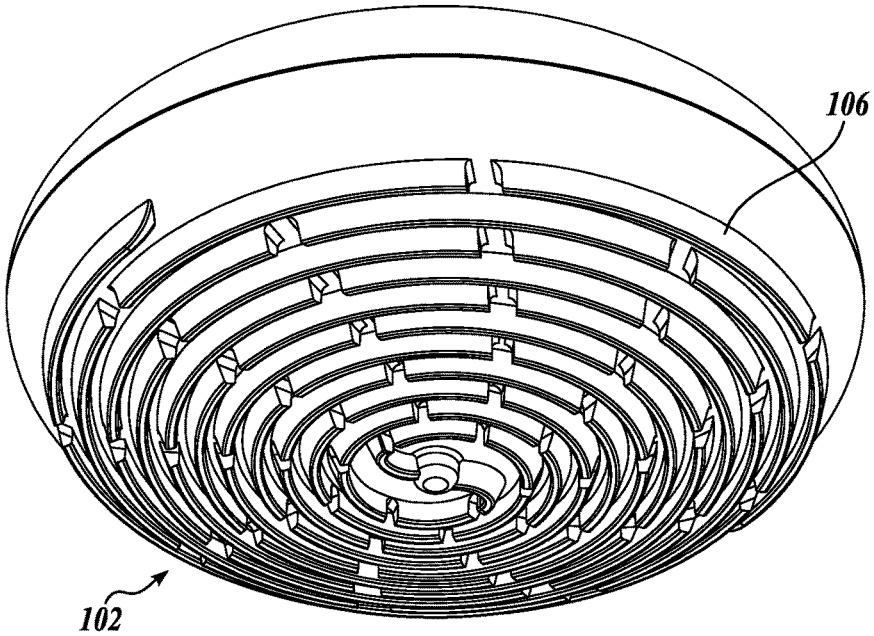
FIG. 2 is a perspective view illustration of a bottom side of the pad cleaner and storage tool of FIG. 1.
Figure 3:
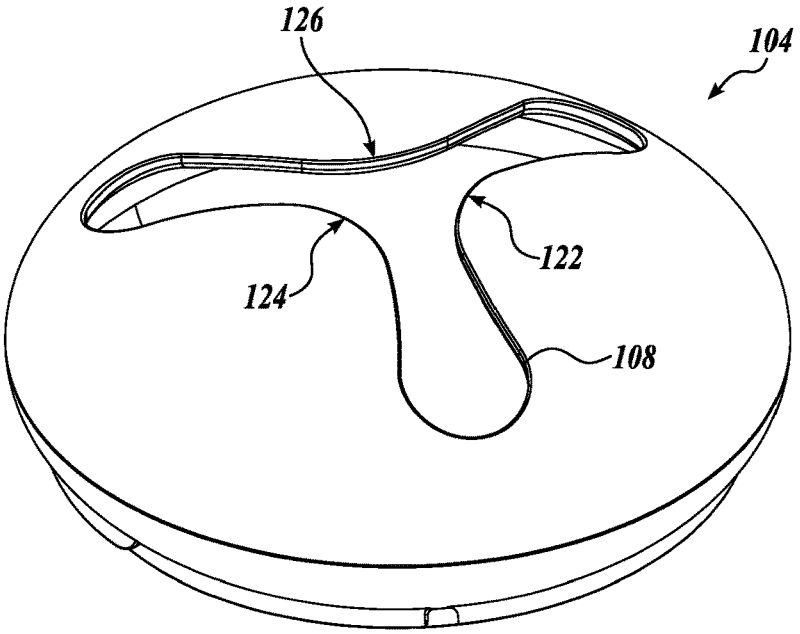
FIG. 3 is a perspective view illustration of a top side of the pad cleaner and storage tool of FIG. 1.
Figure 4:
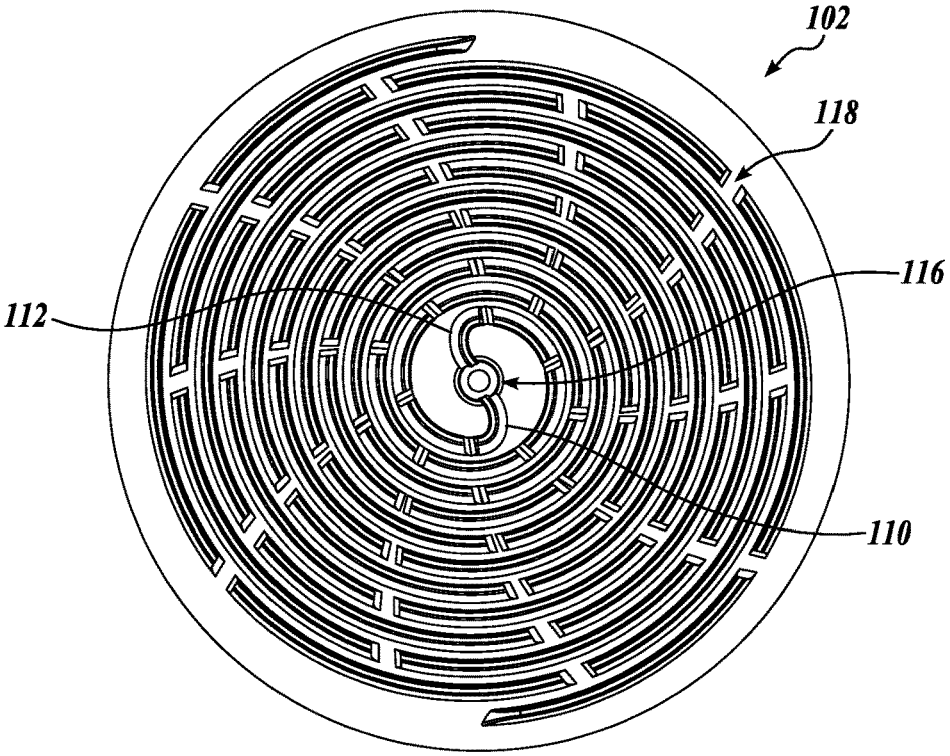
FIG. 4 is a plan view illustration of the bottom side of pad cleaner and storage tool of FIG. 1.
Figure 5:
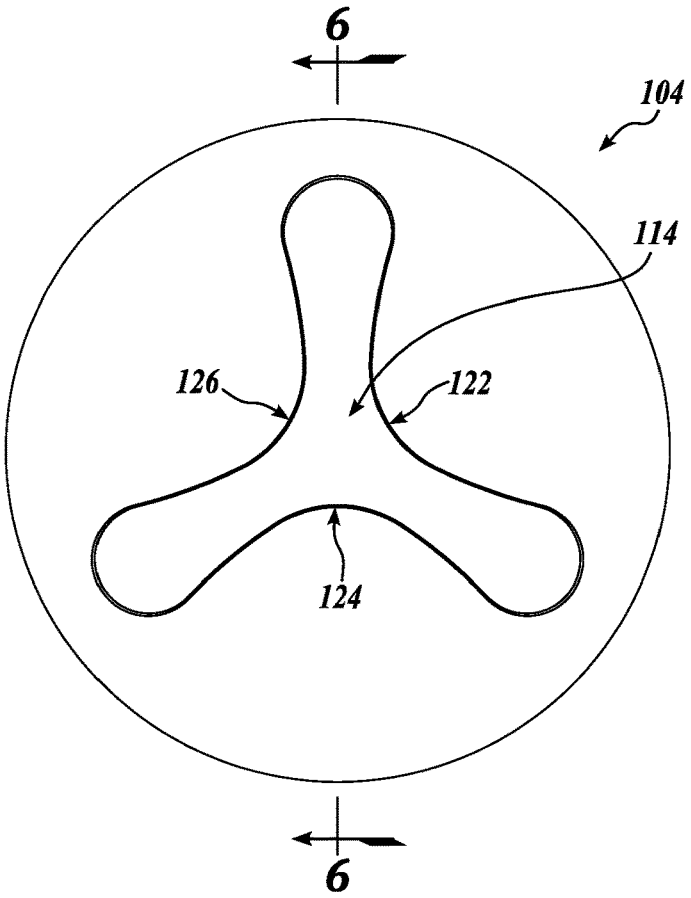
FIG. 5 is a plan view illustration of the top side of the pad cleaner and storage tool of FIG. 1.

FIGS. 1 to 6 illustrate one embodiment of a pad cleaner and storage tool 100 (hereafter "pad cleaner"). The pad cleaner 100 is a three-dimensional object having an overall shaped that may be described as ellipsoid, spherical flattened at the poles, two convex surfaces joined to one another. However, the outer shape of the pad cleaner 100 does not have to follow any mathematical formula that can be used to describe such curved surfaces. Generally described, the pad cleaner 100 has an upper surface 104 that bows upward and a lower surface 102 that bows downward. In plan view, both the upper surface 104 and the lower surface 102 describe a circle as seen in FIGS. 4 and 5. However, a circle shape in plan view is one example, and other examples of the pad cleaner 100 can have shapes other than a circle in plan view. In some examples, the pad cleaner 100 can be described as resembling a "stone" design, because the pad cleaner bulges at the center in both the up and down directions and the thickness decreases radially from the center to the edges.

The design provides consumers an easy to use tool, which can store their makeup removal (microfiber) pads and clean both their makeup removal pads and makeup brushes with one tool. The pad cleaner 100 shape allows the consumer to hold it in an ergonomic way, while scrubbing the pad with the textured, exterior surface.

Dirty makeup removal pads and brushes gather bacteria, dirt, dead skin cells, and oil which can clog pores and lead to acne and poor makeup removal and application. The disclosed textured, spiral design surface of the examples creates less friction, allowing the consumer to gently glide and scrub deeper into the microfiber hairs to remove accumulated residue.

In one embodiment, the pad cleaner 100 is a reusable, recyclable, compact package to store makeup removal pads. In addition, the pad cleaner 100 has a textured surface to aid cleaning makeup removal pads and brushes.

Figure 1:
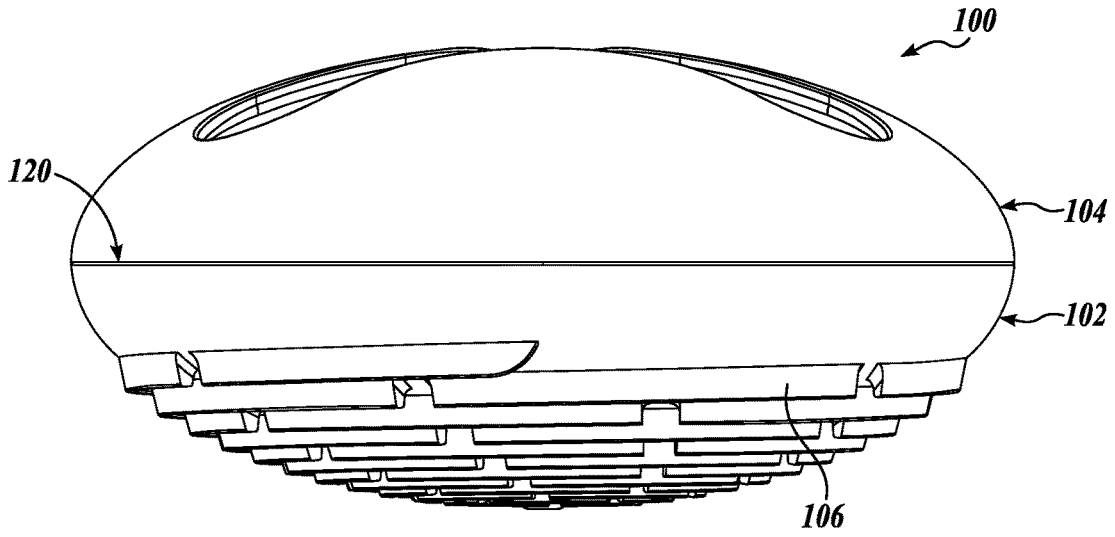
FIG. 1 is a side view illustration of a pad cleaner and storage tool.

Referring to FIG. 1, a plane 120 can be visualized where the upper surface 104 joins the lower surface 102. Such a plane 120 can create mirror images of the upper and lower surfaces. The distance of a perpendicular line from a point on the plane 120 to the lower surface 102 is the same distance of a line from that same point on the plane 120 to the upper surface 104. The depth of the lower surface 102 and upper surface 104 are greatest at the center, and the depth decreases with increasing distance from the center.

Figure 6:
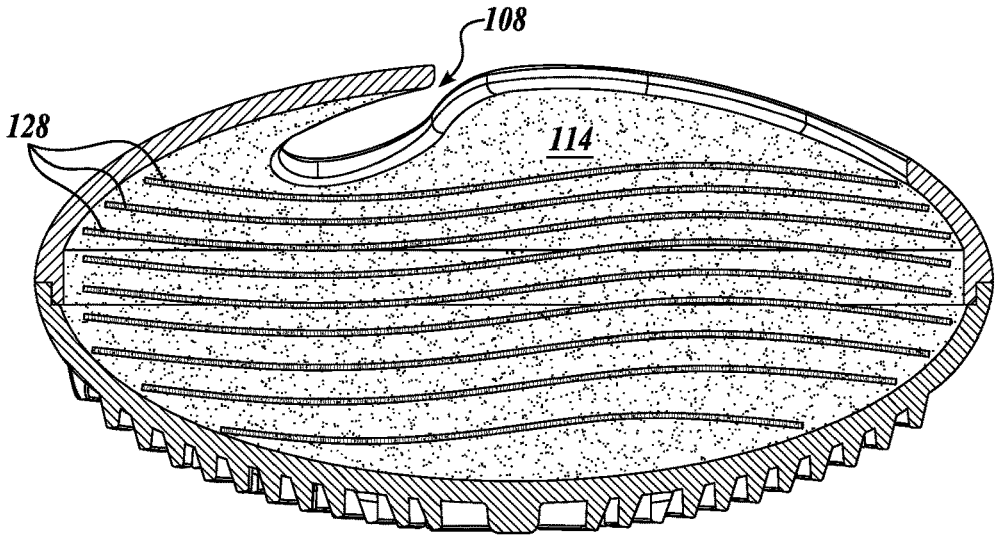
FIG. 6 is a cross-sectional view illustration of the pad cleaner and storage tool of FIG. 1.

The pad cleaner 100 including both the upper surface 104 and the lower surface 102 can be made of rigid and semi-rigid plastics and elastomers. In one embodiment, the pad cleaner 100 is made from materials flexible enough to be turned inside-out. Both the upper surface 104 and the lower surface 102 can have a material thickness sufficient to make it suitable for the applications described herein. The pad cleaner 100 has a hollow center 114 as seen in FIG. 6. In one embodiment, the material of the upper surface 104 is different than the material for the lower surface 102, because of the different functionality each surface performs.

Referring to FIGS. 2 and 4, the lower surface 102 has ridges 106 which are structures extending lengthwise in a curve and heightwise are normal from the surface 102. Thus, ridges 106 closer to the pole or center will be nearly extending vertically down, while ridges 106 become more angled (with respect to a horizontal plane) the closer the ridges are placed to the edge. The ridges 106 can maintain a normal attitude based on the curvature of the surface. In one embodiment, a cross sectional shape of the ridges 106 is wedge-shaped, meaning the ridges are thicker at the base where they attach to the surface and become thinner as they extend away from the surface. The lower textured surface 102 of this example can be used for cleaning any pad, wipe, applicator, brush, and the like.

Referring to FIG. 4, in one embodiment, the ridges 106 are placed along a two-arm spiral pattern, meaning that a first arm 110 radiates out from the center 116, and a second arm 112 radiates out from the center 116, wherein the second arm 112 radiates out from the center 116 directly opposite from the first arm 110. In one embodiment, the center 116 is a circular button extending normal to the surface 102. In one embodiment, the spiral arms 110, 112 from a tight spiral wherein the separation between the arms 110, 112 in the radial direction is about equal to or less than the base of the ridges 106. The separation distance between spiral arms 110, 112 can remain constant or can gradually increase the further the arms 110, 112 extend radially. In one embodiment, the ridges 106 placed along both spiral arms 110 and 112 are discontinuous. That is, the ridges 106 are a discrete length and do not extend continuously for the entire length of the spiral arms 110, 112. In one embodiment, the closer the ridges are placed to the center of the spiral, the shorter the length of the ridges will be. In one embodiment, the length of discrete ridges increases with increasing radial distance from the center 116. In one embodiment, the length of any discrete ridge may cover from about 90 degrees or less around the spiral. In one embodiment, the length of any discrete ridge section may extend 90 degrees to 45 degrees, for example. When the length of the ridges 106 are discrete, gaps 118 are formed in the spiral arms. In one embodiment, the length of the ridges 106 is calculated to place gaps 118 of one spiral arm generally at a middle distance of the other spiral arm. With each revolution of a spiral arm, the gaps only shift a small but consistent degree. For example, the gaps 118 of one spiral arm are generally aligned with the gaps of that same spiral arm, while the gaps 118 of the other spiral arm are also generally aligned only with the gaps of that same spiral arm. In one embodiment, the gaps length, i.e., from the end of one discrete ridge to the start of the adjacent ridge increases with increases radial distance from the center. That is, the gaps 118 in the spiral arm increase in length with every revolution, making the gaps closer to the center are shorter than the gaps further out from the center. The increase in gap 118 length can be at a constant rate. The placement of gaps gives the appearance similar to curved vanes of an impeller or spokes radiating out from the center.

Referring to FIGS. 3 and 5, the upper surface 104 of the pad cleaner 100 will be described. In one embodiment, the upper surface 104 has a cutout 108 entirely through the material thickness exposing a hollow center 114 of the tool 100. In one embodiment, the cutout extends over the center of the upper surface 104, and the cutout extends in three directions, each direction originating from the center, and each direction of the cutout being equidistant from the others. The cutout 108 extends more than half a radius of the upper surface 104 in each of the three directions. In one embodiment, the cutout 108 forms three lobes 122, 124, and 126 of the material of the upper surface 104. The three lobes 122, 124, and 126 are placed equidistant from one another, for example, at 0 degree, 120 degrees, and 240 degrees. In one embodiment, the pad cleaner 100 can be used to store pads 128. The pads 128 can be stored within the hollow center 114 of the pad cleaner 100 as illustrated in FIG. 6. The pads 128 can be dispensed through the opening 108 in the upper surface 104. The lobes 122, 124, and 126 can be made from a flexible material to function as a dispenser. In one embodiment, the upper surface 104 is removable from the lower surface 102 of the pad cleaner to allow refillable the pads 128. In one embodiment, the pad cleaner 100 can be turned inside out using the cutout opening 108.

Figure 7:
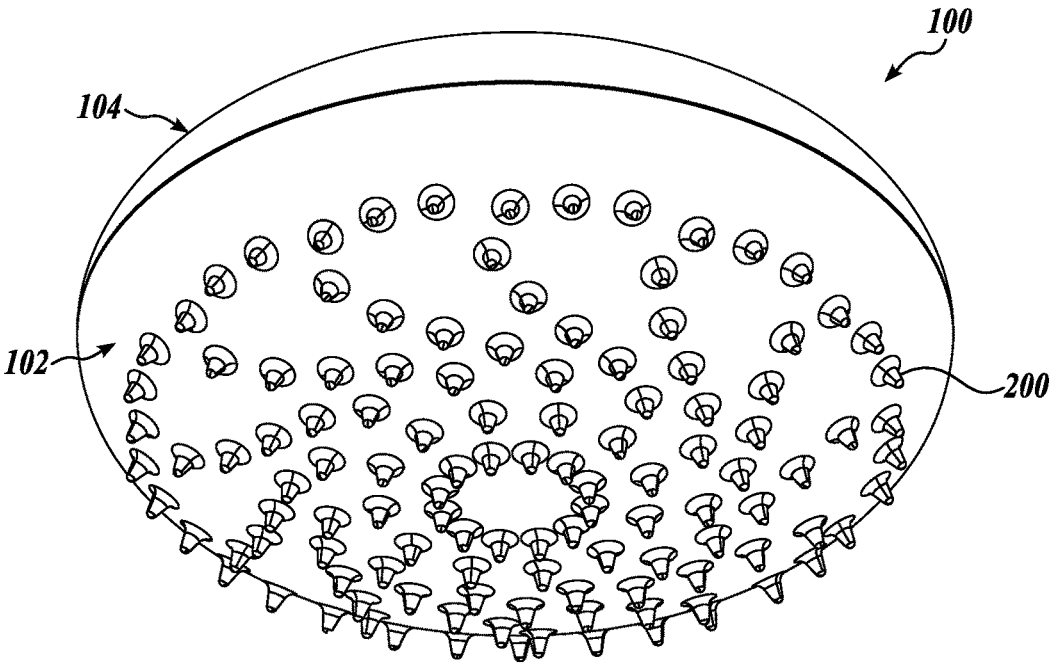
FIG. 7 is a perspective view of an alternative bottom side of the pad cleaner and storage tool of FIG. 1.
Figure 8:
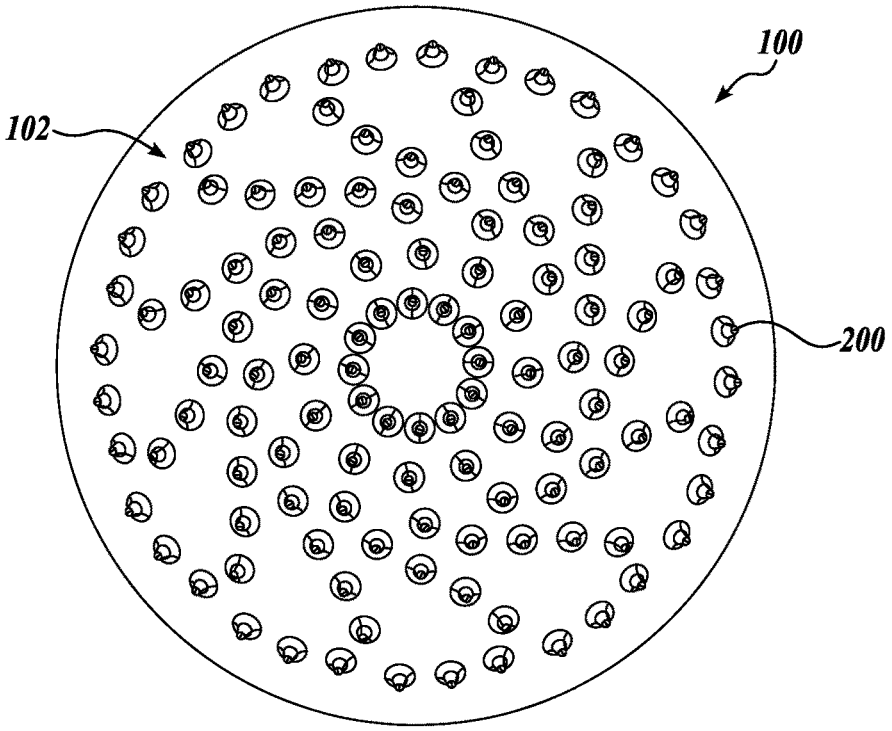
FIG. 8 is a plan view illustration of the alternative bottom side of the pad cleaner and storage tool of FIG. 7.

FIGS. 7 and 8 illustrate an alternative textured surface for cleaning, but, is similar to the example of FIGS. 1 to 6 in other respects, where like numbers represent like part. In the example of FIGS. 7 and 8, the textured surface 102 includes discrete spikes 200 that extend normal to the surface 102. In one embodiment, the spikes 102 have a cone shape with a wide circular base that tapers from the base to the tip of the spike. In one example, the spikes 200 are arranged in the following pattern. The center of the surface 102 has a tight circle of spikes 200, wherein the bases of the spikes 200 are touching or nearly touching the adjacent spikes. Moving radially out from the center circle, there is an arrangement of spikes 200 in a larger circle, wherein there can be more than one spike base diameter separation between adjacent spikes in the larger circle. The larger circle and the center circle are concentric with each other. Next, outward from the larger circle, the spikes 200 are arranged in lines or "spokes," wherein such lines are placed originating from a tangent from the larger circle. The spikes 200 placed along these tangent lines can number about five or more or less, and the number of lines can number about twelve or more or less. The spikes placed along the tangent lines are spaced about one base diameter from adjacent spikes on the same line. The spikes on these tangent "lines" can deviate slightly from a perfectly straight line, but, still have the overall appearance of spokes originating at a tangent from the larger circle of spikes. The spikes 200 placed outward from the center can be considered to be arranged in a twelve-arm spiral pattern. The outermost spikes 200 in the pattern are arranged in a perimeter circle that is close to the edge circumference of the lower surface 102.

While illustrative embodiments have been illustrated and described, it will be appreciated that various changes can be made therein without departing from the spirit and scope of the invention.

The embodiments of the invention in which an exclusive property or privilege is claimed are defined as follows:

1. A pad cleaner, comprising:

a first surface bowed in the center which curves down from the center radially outward to the edges of the first surface;

a second surface bowed in the center, which curves up from the center radially outward to the edges of the second surface, wherein the first surface is joined to the second surface at the edges of both surfaces forming a hollow center;

ridges or spikes extending normal to the second surface are arranged in a pattern on the second surface;

the first surface has a cutout extending through a material thickness of the first surface to expose the hollow center; and pads in the hollow center, and the cutout is for dispensing the pads.

2. The pad cleaner of claim 1, comprising discrete ridges arranged in a two-arm spiral on the second surface.

3. The pad cleaner of claim 2, wherein two spiral arms originate opposite to each other from the center of the second surface.

4. The pad cleaner of claim 3, wherein the radial separation distance between the two spiral arms remains constant.

5. The pad cleaner of claim 2, wherein discrete ridges extend between 45 degrees to 90 degrees of the spiral arms.

6. The pad cleaner of claim 5, wherein the discrete ridges increase in length with increase in radial distance from the center.

7. The pad cleaner of claim 2, wherein gaps separate the ends of the discrete ridges.

8. The pad cleaner of claim 7, wherein the gaps increase in length between the discrete ridges with increasing radial distance from the center.

9. The pad cleaner of claim 1, comprising discrete spikes arranged in more than two spiral arms originating from the center.

10. The pad cleaner of claim 9, wherein the spikes are arranged in twelve spiral arms originating from a circle arrangement of spikes at the center of the second surface.

11. The pad cleaner of claim 9, comprising a circular arrangement of spikes at close to the edge of the second surface.

12. The pad cleaner of claim 1, wherein the first surface and the second surface give an overall ellipsoid shape to the pad cleaner.

13. The pad cleaner of claim 1, wherein the first surface and the second surface are made from an elastomer.

14. A pad cleaner, comprising:

a first surface bowed in the center which curves down from the center radially outward to the edges of the first surface;

a second surface bowed in the center, which curves up from the center radially outward to the edges of the second surface, wherein the first surface is joined to the second surface at the edges of both surfaces forming a hollow center;

ridges or spikes extending normal to the second surface are arranged in a pattern on the second surface; and the first surface has a cutout extending through a material thickness of the first surface to expose the hollow center, wherein the first surface has three lobes placed equidistant apart from one another around the cutout.

* * * * *